US012578151B2

(12) United States Patent
Chen et al.

(10) Patent No.: US 12,578,151 B2
(45) Date of Patent: Mar. 17, 2026

(54) MANUFACTURING METHOD OF VAPOR CHAMBER

(71) Applicant: Shenzhen VC Thermal Technology Co., Ltd., Shenzhen (CN)

(72) Inventors: Yu Chen, Shenzhen (CN); Jianwei Li, Shenzhen (CN)

(73) Assignee: Shenzhen VC Thermal Technology Co., Ltd., Shenzhen (CN)

( * ) Notice: Subject to any disclaimer, the term of this patent is extended or adjusted under 35 U.S.C. 154(b) by 0 days.

(21) Appl. No.: 19/066,253

(22) Filed: Feb. 28, 2025

(65) Prior Publication Data

US 2025/0362092 A1 Nov. 27, 2025

(30) Foreign Application Priority Data

May 24, 2024 (CN) ..... 202410656685.9

(51) Int. Cl.
*F28D 15/04* (2006.01)
*B23P 15/26* (2006.01)

(52) U.S. Cl.
CPC ..... *F28D 15/04* (2013.01); *F28F 2255/00* (2013.01); *F28F 2275/067* (2013.01); *F28F 2280/00* (2013.01)

(58) Field of Classification Search
CPC ..... B23P 15/26; B21D 53/02
See application file for complete search history.

(56) References Cited

U.S. PATENT DOCUMENTS 4,682,002 A * 7/1987 Delle Piane ..... B23K 26/037 219/121.64
4,847,467 A * 7/1989 Ausilio ..... B23K 37/0435 219/161
7,327,978 B2 * 2/2008 de Jong ..... G03G 15/2053 399/328
10,739,081 B2 * 8/2020 Zhou ..... F28D 15/0233

FOREIGN PATENT DOCUMENTS

CN 107809880 A 3/2018
CN 113894504 A 1/2022
CN 113996930 A 2/2022

OTHER PUBLICATIONS

Office Action received in corresponding Chinese patent application No. 202410656685.9, dated Feb. 23, 2025, 12 pages.

* cited by examiner

*Primary Examiner* — Sarang Afzali
(74) *Attorney, Agent, or Firm* — Cooper Legal Group, LLC

(57) ABSTRACT

The present application relates to a manufacturing method of a vapor chamber, including processing an upper cover and a lower cover into predetermined shapes; fixing a capillary structure on a surface of an inner chamber of the lower cover; injecting a working liquid into the capillary structure; and fixing the upper cover and the lower cover in a vacuum environment. The present application has an effect of more accurately control of a quality of the working liquid.

5 Claims, 2 Drawing Sheets

MANUFACTURING METHOD OF VAPOR CHAMBER

CROSS-REFERENCE TO RELATED APPLICATION

This application claims the priority to Chinese patent application serial no. 202410656685.9, filed on May 24, 2024. The entirety of Chinese patent application serial no. 202410656685.9 is hereby incorporated by reference herein and made a part of this specification.

TECHNICAL FIELD

The present application relates to a technical field of heat dissipation devices, and, in particular, to a manufacturing method of a vapor chamber.

BACKGROUND ART

With a development of miniaturization of an electronic product and a continuous compression of product space, an actual convective heat transfer area of original passive heat dissipation solution is small, resulting in an accumulation of heat from an original power consuming product of a chip, causing a local temperature of the product to be too high and affecting normal experience, however, a vapor chamber can be used as a separate heat dissipation solution to transfer and dissipate heat, which can effectively diffuse heat horizontally to a surface.

In a related technology, a manufacturing method of a vapor chamber is as follows: first, machining an upper cover and a lower cover into predetermined shapes; second, fixing a capillary structure on a surface of an inner chamber of the lower cover; third, welding the upper cover and the lower cover together, leaving a welding port as an injection port during welding; fourth, inserting an end of an injection tube into the injection port and sealing a joint between the injection port and the injection tube; fifth, injecting a working liquid into a chamber through the injection tube; sixth, evacuating the chamber through the injection tube, and clamping an end port of the injection tube after evacuation; seventh, heating the chamber of a temporary sealed product to drive a remaining air into the injection tube through an evaporation of the working liquid, after heating for a certain period of time, welding the injection port; eighth, cutting off the injection tube and injection port.

The related technology mentioned above has the following defects: firstly, the working liquid that is not adsorbed by the capillary structure during a vacuum evacuation process will be sucked away; secondly, during a heating and air exhaust process, some of the working liquid will evaporate and leave the chamber of the product, which can easily lead to difficulty in controlling a quality of the working liquid inside the product.

SUMMARY

In order to more accurately control the quality of the working liquid, the present application provides a manufacturing method of a vapor chamber.

The manufacturing method of the vapor chamber provided in the present application adopts the following technical solutions.

A manufacturing method of a vapor chamber, including the following steps:

processing an upper cover and a lower cover into predetermined shapes;

fixing a capillary structure on a surface of an inner chamber of the lower cover;

injecting a working liquid into the capillary structure;

fixing the upper cover and the lower cover in a vacuum environment.

By adopting the above technical solution, the working liquid is injected first, and then the upper cover and the lower cover are fixed in the vacuum environment, so there is no need to exhaust an air inside an inner chamber of a product through pumping and heating, which can more accurately control the quality of the working liquid and simplify a production process of the product, in addition, designs of an injection port and an injection tube are also eliminated, thereby reducing production costs.

Optionally, the step of injecting the working liquid into the capillary structure is completed in the vacuum environment, wherein a temperature of the vacuum environment is maintained at or below 30° C.

By adopting the above technical solution, if an injection of the working liquid and a fixing of the upper cover and the lower cover are both in the vacuum environment, a step of transferring the lower cover and the capillary structure into the vacuum environment can be eliminated to improve production efficiency, at the same time, because the lower an air pressure, the faster an evaporation, a temperature control of the environment where the working liquid is dropped can better reduce the evaporation of the working liquid, thereby achieving more accurately control of the quality of the working liquid.

Optionally, in the step of injecting the working liquid into the capillary structure, when an area occupied by the capillary structure is larger than an area where the working liquid diffuses once dropped, if the capillary structure is distributed in a rectangular shape, the working liquid is injected sequentially along a length direction of the capillary structure, if the capillary structure is distributed in a square shape, the working liquid is injected gradually away from a center of the capillary structure.

By adopting the above technical solution, due to it takes some time for the capillary structure to adsorb the working liquid, and the lower the air pressure, the stronger an evaporation ability, a mobile liquid injection method can distribute the working liquid reasonably according to a shape of the product, so that the capillary structure can adsorb the working liquid more quickly, thereby reducing the evaporation of the working liquid and more accurately controlling the quality of the working liquid in the capillary structure.

Optionally, the step of fixing the upper cover and the lower cover in the vacuum environment includes:

placing the upper cover to the lower cover at a predetermined position;

positioning the upper cover and the lower cover; and welding the upper cover and the lower cover.

By adopting the above technical solution, after accurate positioning, a welding treatment should be carried out to improve a sealing of a connection between the upper cover and the lower cover.

Optionally, in the step of positioning the upper cover and the lower cover, a joint between the upper cover and the lower cover is divided into a clamping area and a welding area, and the clamping area is closer to a center of a shape of the upper cover and the lower cover than the welding area.

By adopting the above technical solution, compared to a method where the joint between the upper cover and the lower cover is not directly subjected to clamping force, this design method applies clamping force directly to the clamping area to improve a sealing of the joint between the upper cover and the lower cover, therefore, when welding the welding area, the working liquid evaporated is less likely to leak out of an inner chamber of the product, thus enabling more accurately control of the quality of the working liquid.

Optionally, in the step of positioning the upper cover and the lower cover, a lower clamping block of a fixture is provided with a lower limiting groove, the lower limiting groove is configured for arranging the lower cover, a side wall of the lower limiting groove abuts against a peripheral side of the lower cover, an upper clamping block of the fixture is provided with an upper limiting groove, the upper limiting groove is configured for arranging the upper cover in an area inside the clamping area to form a matching stepped portion at the clamping area of the upper cover.

By adopting the above technical solution, firstly, a coordination between the lower limiting groove and the lower cover, as well as a coordination between the matching stepped portion and the upper cover, achieves a purpose of fully positioning the upper cover and the lower cover of the product, at the same time, the fixture is wrapped around the product, so the fixture can utilize material characteristics to better dissipate heat for the product during a welding process, in order to maintain a yield of the product; secondly, a providing of the upper limiting groove can completely press a center position of the upper cover, so that when the working liquid evaporates during welding, the product can be prevented from deformation through a clamping of the upper cover.

Optionally, in the step of welding the upper cover and the lower cover, a laser welding is used for welding treatment.

By adopting the above technical solution, the laser welding only requires an installation of a laser head in a sealed vacuum environment, so an overall volume of a device can be reduced to reduce a difficulty of maintaining a vacuum sealing of the equipment.

Optionally, in the step of welding the upper cover and the lower cover, two welding positions of a front and rear are symmetrically provided relative to the center of the shape of the upper cover.

By adopting the above technical solution, in a case where the joint between the upper and lower covers is thick and product specifications are large, the two welding positions of the front and rear can be diagonally replaced to balance a temperature difference in different positions of the vacuum environment, thereby maintaining an uniformity of air pressure in the sealed vacuum environment and more stably maintaining the sealing of the vacuum environment, in addition, during the welding process, a direction of movement of the working liquid inside the product will constantly change after evaporation, so different positions of the capillary structure can fully adsorb the working liquid to improve the yield of the product.

Optionally, a surface of a side of the lower clamping block away from the upper clamping block is exposed outside the vacuum environment, the surface of the side exposed outside the vacuum environment is in contact with a cooling water, and the cooling water seals a gap between the lower clamping block and a box containing the vacuum environment.

By adopting the above technical solution, compared to the fixture being completely in the vacuum environment, this design method can use the cooling water to dissipate heat more quickly to the fixture if a thickness of the upper cover and the lower cover is large and a welding time in an unit area is longer, at the same time, the product is still in the vacuum environment, and the cooling water can also seal the gap between the lower clamping block and the box to further maintain the sealing of the vacuum environment.

Optionally, after the step of welding the upper cover and the lower cover, releasing a clamping and positioning of a product after a temperature of the product drops below 30° C.

By adopting the above technical solution, due to the evaporation of the working liquid, an internal pressure of the product will increase, but the product is still in the vacuum environment at this time, therefore, after the temperature of the product is lowered to 30° C., the working liquid is no longer in an evaporation state, therefore, there will be no deformation of the product after releasing a clamping of the fixture in a future.

In summary, the present application includes at least one of the following beneficial technical effects:

1. the working liquid is injected first, and then the upper cover and the lower cover are fixed in the vacuum environment, so there is no need to exhaust the air inside the inner chamber of the product through pumping and heating, which can more accurately control the quality of the working liquid and simplify the production process of the product, in addition, designs of the injection port and the injection tube are also eliminated, thereby reducing production costs;
2. due to it takes some time for the capillary structure to adsorb the working liquid, and the lower the air pressure, the stronger the evaporation ability, the mobile liquid injection method can distribute the working liquid reasonably according to the shape of the product, so that the capillary structure can adsorb the working liquid more quickly, thereby reducing the evaporation of the working liquid and more accurately controlling the quality of the working liquid in the capillary structure.

DETAILED DESCRIPTION

Figure 1:
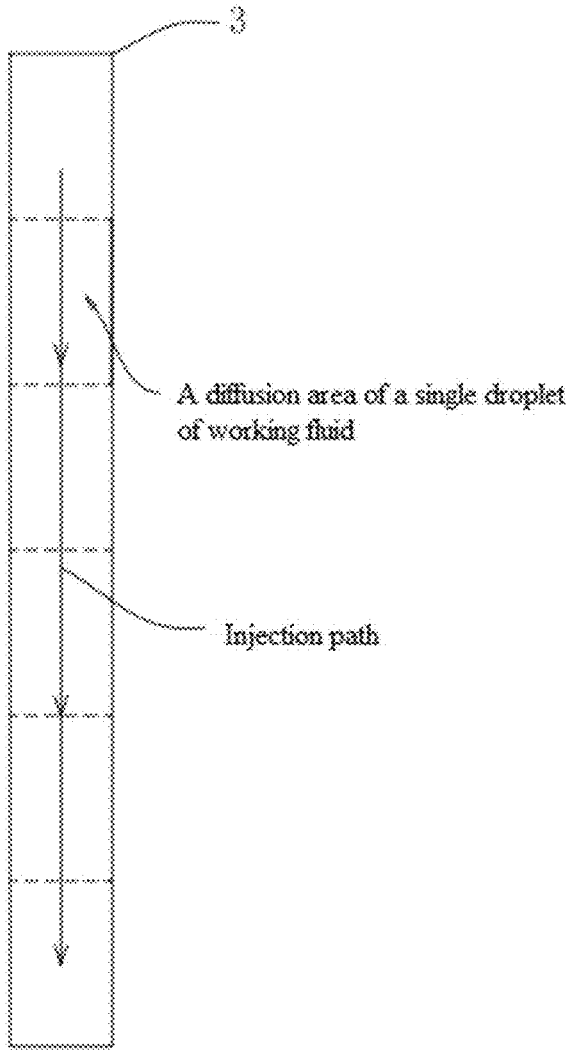
FIG. 1 is a schematic view of liquid injection in an embodiment of the present application with a capillary structure distributed in a rectangular shape.

The present application is further described in detail below with reference to FIGS. 1-3.

A manufacturing method of a vapor chamber is disclosed in the embodiment of the present application. The manufacturing method of the vapor chamber includes the following steps:

Firstly, processing an upper cover 1 and a lower cover 2 into predetermined shapes, specifically, which can be processed through stamping, etching, and CNC, the upper cover 1 and lower cover 2 can be made of stainless steel, copper, and titanium, but not limited to these three materials; secondly, fixing a capillary structure 3 on a surface of an inner chamber of the lower cover 2.

Thirdly, dropping a working liquid into the capillary structure 3, the working liquid is deionized water; if an injection is not completed in a vacuum environment, the capillary structure 3 and the lower cover 2 need to be transferred to the vacuum environment after the injection is completed, therefore, the capillary structure 3 needs to be firmly fixed on the lower cover 2; if the injection is completed in the vacuum environment, the capillary structure 3 can be detachably fixed to the lower cover 2 by directly placing the capillary structure 3 on the lower cover 2 through a supporting column structure of the lower cover 2 before injection, at the same time, considering that an evaporation of the working liquid will accelerate, it is necessary to make the capillary structure 3 absorb the working liquid more quickly, according to different size and specifications of product, there will be corresponding different dripping methods. Specifically, referring to FIGS. 1 and 2, if the capillary structure 3 is distributed in a rectangular shape, the working liquid is injected sequentially along a length direction of the capillary structure 3, if the capillary structure 3 is distributed in a square shape, the working liquid is injected gradually away from a center of a shape of the capillary structure 3, so that the capillary structure 3 at different positions can more fully adsorb the working liquid, in addition, it should be noted that a temperature also affects the evaporation of the working liquid, so the temperature of the vacuum environment needs to be kept below 30° C.

Fourthly, fixing the upper cover 1 and the lower cover 2 in the vacuum environment; specifically, if a liquid injection is completed in a non-vacuum environment, the lower cover 2 needs to be fixed at a predetermined position in the vacuum environment first, if the liquid injection is completed in the vacuum environment, the lower cover 2 is fixed at the predetermined position in the vacuum environment during a liquid injection process, therefore, after the liquid injection is completed, only placing the upper cover 1 to the lower cover 2 first, then positioning the upper cover 1 and the lower cover 2, and then welding the upper cover 1 and the lower cover 2; when positioning, it is not only necessary to maintain stability of positions of the upper cover 1 and the lower cover 2, but also to prevent a leakage of the working liquid evaporated during a welding process, therefore, special provisions are required for positioning methods of the product.

Figure 3:
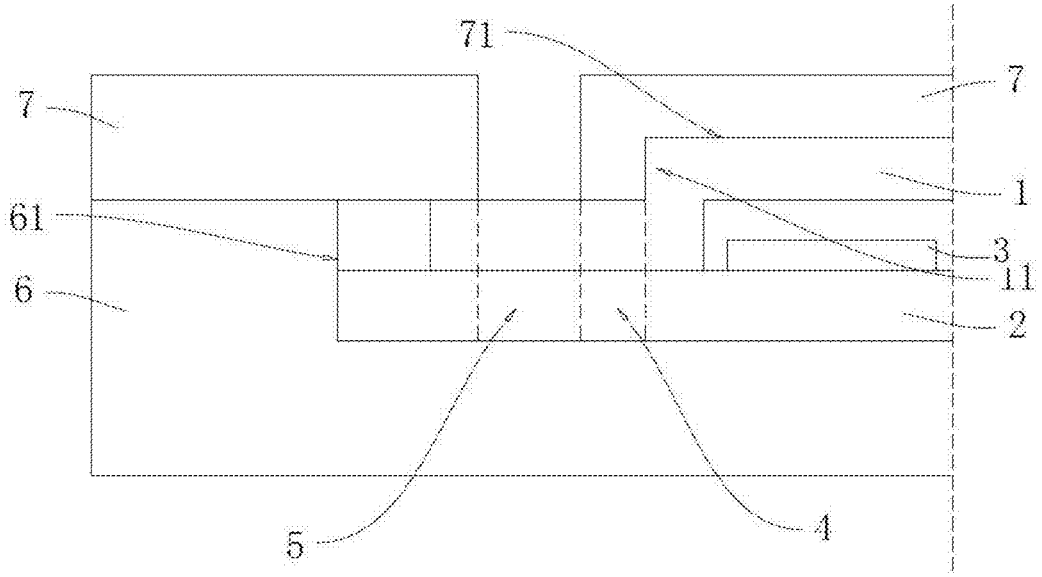
FIG. 3 is a schematic view shows how an upper cover and a lower cover are positioned in the embodiment of the present application.

Referring to FIG. 3, a joint between the upper cover 1 and lower cover 2 is divided into a clamping area 4 and a welding area 5, both the clamping area 4 and the welding area 5 are provided in a circular distribution, and the clamping area 4 is closer to a center of a shape of the upper cover 1 and the lower cover 2 than the welding area 5, the clamping area 4 can directly subjected to a clamping force applied by clamping, the welding area 5 needs to provide sufficient area for welding, so it can achieve inner clamping and outer welding, thereby better preventing the leakage of the working liquid and more accurately controlling a quality of the working liquid.

Referring to FIG. 3, in order to achieve a special positioning method mentioned above, a lower clamping block 6 of a fixture is provided with a lower limiting groove 61, which can be used to accommodate the lower cover 2, a peripheral side of the lower cover 2 is abut against a side wall of the lower limiting groove 61 to achieve a position positioning of the lower cover 2, an upper clamping block 7 of the fixture is provided with an upper limiting groove 71, and a part of the upper cover 1 located inside the clamping area 4 is in the upper limiting groove 71, therefore, the upper cover 1 will form a matching stepped portion 11 with a stepped structure close to the clamping area 4 to achieve positioning of the upper cover 1, a gap between the upper clamping block 7 and the lower clamping block 6 will align with a position of the welding area 5. Thus, a positioning fixture that meets requirements of inner clamping and outer welding is formed.

In addition, in this embodiment, a structure of this positioning fixture further has the following advantages: firstly, the fixture is wrapped around the product, so the fixture can utilize material characteristics to better dissipate heat for the product during the welding process, in order to maintain a yield of the product; secondly, the upper limiting groove 71 completely presses a center position of the upper cover 1, so that when the working liquid evaporates during welding, the product can be prevented from deformation by a clamping of the upper cover 1.

When welding, it is necessary to consider an impact of heat generated by welding on the product and a box containing the vacuum environment, there are corresponding optimization settings. Firstly, welding treatment can be carried out through a laser welding, specifically, installing a laser head inside the box containing the vacuum environment can achieve this, therefore, a size of the box containing the vacuum environment does not need to be very large, which can more stably maintain a vacuum sealing of the box.

Figure 2:
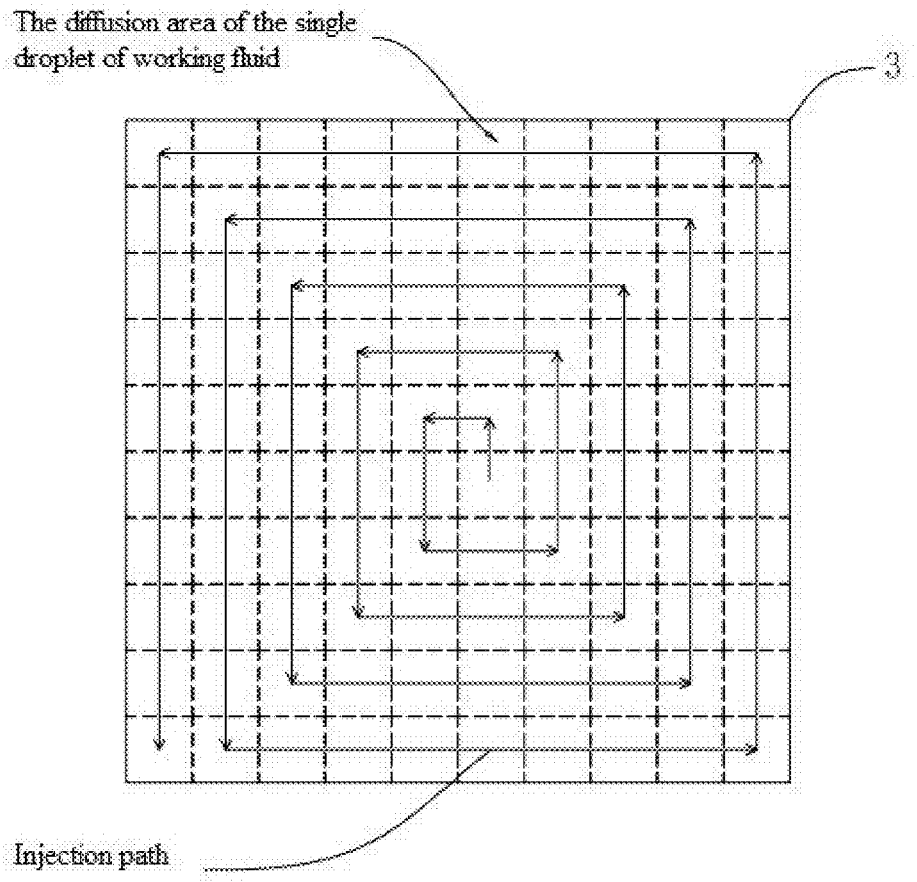
FIG. 2 is a schematic view of liquid injection in the embodiment of the present application with the capillary structure distributed in a square shape.

Secondly, if a thickness of the joint between the upper cover 1 and the lower cover 2 is large, resulting in a longer welding time per unit area, if product specifications are large, welding positions are not provided continuously, specifically, referring to FIG. 1, two welding positions of a front and rear are symmetrically provided at the center of the shape of the upper cover 1, so as to balance a temperature difference at different positions in the vacuum environment and maintain an uniformity of air pressure in a closed vacuum environment, at the same time, during the welding process, a direction of movement of the working liquid inside the product can constantly change after evaporation, the different positions of the capillary structure 3 can fully adsorb the working liquid, thereby improving the yield of the product, in addition, if the product specifications are small, the front and rear weldings need to be separated for a period of time, to prevent the product from overheating.

Thirdly, heat dissipation in the vacuum environment is mainly achieved through solid conduction, therefore, in order to efficiently dissipate heat from the product while stability maintaining the product in the vacuum environment, a surface of a side of the lower clamping block 6 away from the upper clamping block 7 is exposed on an outer surface of the box containing the vacuum environment, that is, a lower surface of the lower clamping block 6 is exposed outside the vacuum environment, and the surface of the side exposed outside the vacuum environment is in contact with a cooling water to achieve more efficient heat dissipation for the product, in addition, considering that a gap between the lower clamping block 6 and the box containing the vacuum environment can also affect a vacuum sealing performance, so the cooling water needs to seal the gap between the lower clamping block 6 and the box containing the vacuum environment.

After the welding is completed, the temperature of the product is not immediately decrease, so it is necessary to wait for the working liquid inside the product to stop evaporating before releasing the clamping and positioning of the product, specifically, the temperature generally needs to be lowered to below 30° C.

An implementation principle of the manufacturing method of the vapor chamber in the present application is as followings: injecting the working liquid and fixing the upper cover 1 and lower cover 2 in the vacuum environment, so there is no need to exhaust the air inside the inner chamber of the product through pumping and heating, which can more accurately control the quality of the working liquid and simplify the production process of the product, in addition, designs of an injection port and an injection tube are also eliminated, thereby reducing production costs.

The above are the preferred embodiments of the present application, which are not intended to limit the protection scope of the present application. Therefore, all equivalent changes made according to the structure, shape and principle of the present application should be covered within the protection scope of the present application.

LIST OF REFERENCE SIGNS

1 upper cover
11 matching stepped portion
2 lower cover
3 capillary structure
4 clamping area
5 welding area
6 lower clamping block
61 lower limiting groove
7 upper clamping block
71 upper limiting groove

What is claimed is:

1. A manufacturing method of a vapor chamber, the manufacturing method comprising the following steps:

processing an upper cover and a lower cover into predetermined shapes;

fixing a capillary structure on a surface of an inner chamber of the lower cover;

injecting a working liquid into the capillary structure; and fixing the upper cover and the lower cover in a vacuum environment;

wherein the step of fixing the upper cover and the lower cover in the vacuum environment comprises:

placing the upper cover relative to the lower cover at a predetermined position;

positioning the upper cover and the lower cover; and welding the upper cover and the lower cover;

wherein in the step of positioning the upper cover and the lower cover, a joint between the upper cover and the lower cover is divided into a clamping area and a welding area, and the clamping area is closer to centers of the upper cover and the lower cover than the welding area;

wherein in the step of positioning the upper cover and the lower cover, a lower clamping block of a fixture is provided with a lower limiting groove, the lower limiting groove is configured for arranging the lower cover, a side wall of the lower limiting groove abuts against a peripheral side of the lower cover, an upper clamping block of the fixture is provided with an upper limiting groove, and the upper limiting groove is configured for arranging the upper cover in an area inside the clamping area to form a matching stepped portion at the clamping area of the upper cover;

wherein a surface of a side of the lower clamping block away from the upper clamping block is exposed outside the vacuum environment, the surface of the side exposed outside the vacuum environment is in contact with a cooling water, and the cooling water seals a gap between the lower clamping block and a box containing the vacuum environment.

2. The manufacturing method of the vapor chamber according to claim 1, wherein the step of injecting the working liquid into the capillary structure is completed in the vacuum environment, wherein a temperature of the vacuum environment is maintained at or below 30° C.

3. The manufacturing method of the vapor chamber according to claim 2, wherein in the step of injecting the working liquid into the capillary structure:

when the capillary structure is distributed in a rectangular shape, the working liquid is injected sequentially along a length direction of the capillary structure, and when the capillary structure is distributed in a square shape, the working liquid is injected gradually away from a center of the capillary structure.

4. The manufacturing method of the vapor chamber according to claim 1, wherein in the step of welding the upper cover and the lower cover, a laser welding is used for welding treatment.

5. The manufacturing method of the vapor chamber according to claim 1, wherein after the step of welding the upper cover and the lower cover, the manufacturing method comprises releasing a clamping and positioning of the vapor chamber prepared after the welding after a temperature of the vapor chamber drops below 30° C.

* * * * *